US009057287B2

(12) United States Patent
Sadhu et al.

(10) Patent No.: US 9,057,287 B2
(45) Date of Patent: Jun. 16, 2015

(54) BUTTERFLY PLATE FOR A STEAM TURBINE EXHAUST HOOD

(75) Inventors: Antanu Sadhu, Karnataka (IN); Prakash Bavanjibhai Dalsania, Karnataka (IN); Shashwat Swami Jaiswal, Karnataka (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 942 days.

(21) Appl. No.: 13/221,044

(22) Filed: Aug. 30, 2011

(65) Prior Publication Data

US 2013/0047612 A1 Feb. 28, 2013

(51) Int. Cl.
*F01D 25/24* (2006.01)
*F01D 25/30* (2006.01)

(52) U.S. Cl.
CPC ..... *F01D 25/24* (2013.01); *F01D 25/30* (2013.01); *F05D 2250/70* (2013.01); *F05D 2250/711* (2013.01)

(58) Field of Classification Search
CPC ..... F01D 25/24; F01D 25/28; F01D 25/30; F05D 2250/70; F05D 2250/711
USPC ..... 415/211.2, 212.1, 220, 224.4, 189
See application file for complete search history.

(56) References Cited

U.S. PATENT DOCUMENTS

| | | | |
|---|---|---|---|
| 1,938,800 | A | 12/1933 | Bourne |
| 2,991,927 | A | 7/1961 | Quick |
| 3,149,470 | A | 9/1964 | Herzog |
| 3,735,782 | A | 5/1973 | Strscheletzky |
| 4,013,378 | A | 3/1977 | Herzog |
| 4,214,452 | A | 7/1980 | Riollet et al. |
| 4,326,832 | A | 4/1982 | Ikeda et al. |
| 4,390,319 | A | 6/1983 | Garkusha et al. |
| 5,203,674 | A | 4/1993 | Vinciguerra |
| 5,257,906 | A | 11/1993 | Gray et al. |
| 5,340,276 | A | 8/1994 | Norris et al. |
| 5,518,366 | A | 5/1996 | Gray |
| 6,419,448 | B1 | 7/2002 | Owczarek |
| 6,629,819 | B1 | 10/2003 | Brown et al. |
| 6,953,104 | B2 | 10/2005 | Monson et al. |
| 6,971,842 | B2 | 12/2005 | Luniewski et al. |
| 7,600,962 | B2 | 10/2009 | Mizumi et al. |
| 7,780,403 | B2 | 8/2010 | Fridsma |
| 8,317,467 | B2 | 11/2012 | Dalsania et al. |
| 2007/0081892 | A1 | 4/2007 | Sharrow |
| 2009/0123277 | A1 | 5/2009 | Dalsania et al. |
| 2009/0263241 | A1 | 10/2009 | Demiraydin et al. |
| 2010/0162705 | A1 | 7/2010 | Sharrow et al. |
| 2010/0247304 | A1 | 9/2010 | Merchant et al. |
| 2010/0251716 | A1 | 10/2010 | Boss et al. |
| 2013/0047612 | A1 | 2/2013 | Sadhu et al. |

FOREIGN PATENT DOCUMENTS

| | | | |
|---|---|---|---|
| EP | 1707762 | A2 | 10/2006 |

*Primary Examiner* — Edward Look
*Assistant Examiner* — Maxime Adjagbe
(74) *Attorney, Agent, or Firm* — Cantor Colburn LLP

(57) ABSTRACT

A steam turbine exhaust hood includes an exhaust hood section, and a butterfly plate arranged in the exhaust hood section. The butterfly plate includes a complex curvilinear cross-sectional profile having a first section that extends between a first end portion and a middle portion, and a second section that extends between the middle portion and a second end portion. One of the first and second sections is formed from at least two curvilinear segments including at least one curvilinear segment having a positive curvature and at least one curvilinear segment having a negative curvature.

20 Claims, 4 Drawing Sheets

BUTTERFLY PLATE FOR A STEAM TURBINE EXHAUST HOOD

BACKGROUND OF THE INVENTION

The subject matter disclosed herein relates to the art of steam turbomachines and, more particularly, to a butterfly plate for a steam turbomachine hood.

Many power generation facilities employ steam turbomachine systems having a low pressure (LP) steam turbine portion coupled to an intermediate pressure (IP) steam turbine portion and a high pressure (HP) steam turbine portion to drive a generator. In general, steam is expanded in the LP steam turbine portion and channeled into an exhaust hood. The exhaust hood separates steam under vacuum from atmospheric conditions, while providing support to rotating and stationary turbomachinery. Generally, stationary components direct steam toward rotating components to facilitate rotor rotation that is employed in power generation. Also, exhaust hoods provide static pressure recovery that allows for additional expansion of gases passing to last stage turbine buckets.

An exemplary exhaust hood is formed from various complex sheet metal plates that are combined to form a shell assembly. The shell assembly is machined to provide connections for internal and external components. The shell assembly includes upper and lower halves that guide steam downward toward a condenser. The exhaust hood includes a butterfly plate that turns an upper steam flow 180° downward toward the condenser. Existing butterfly plates include both linear and elliptical cross-sectional profiles that are formed to turn the upper steam flow vertically downward.

BRIEF DESCRIPTION OF THE INVENTION

According to one aspect of the exemplary embodiment, a butterfly plate for a steam turbine exhaust hood includes a complex curvilinear cross-sectional profile having a first section that extends between a first end portion and a middle portion, and a second section that extends between the middle portion and a second end portion. One of the first and second sections is formed from at least two curvilinear segments including at least one curvilinear segment having a positive curvature and at least one curvilinear segment having a negative curvature.

According to another aspect of the exemplary embodiment, a steam turbine exhaust hood includes an exhaust hood section, and a butterfly plate arranged in the exhaust hood section. The butterfly plate includes a complex curvilinear cross-sectional profile having a first section that extends between a first end portion and a middle portion, and a second section that extends between the middle portion and a second end portion. One of the first and second sections is formed from at least two curvilinear segments including at least one curvilinear segment having a positive curvature and at least one curvilinear segment having a negative curvature.

According to yet another aspect of the exemplary embodiment, a steam turbomachine system includes a turbine portion including an inlet section and an exhaust section, and an exhaust hood mounted about the exhaust section. The exhaust hood includes an exhaust hood section, and a butterfly plate arranged in the exhaust hood section. The butterfly plate includes a complex curvilinear cross-sectional profile having a first section that extends between a first end portion and a middle portion, and a second section that extends between the middle portion and a second end portion. One of the first and second sections is formed from at least two curvilinear segments including at least one curvilinear segment having a positive curvature and at least one curvilinear segment having a negative curvature.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
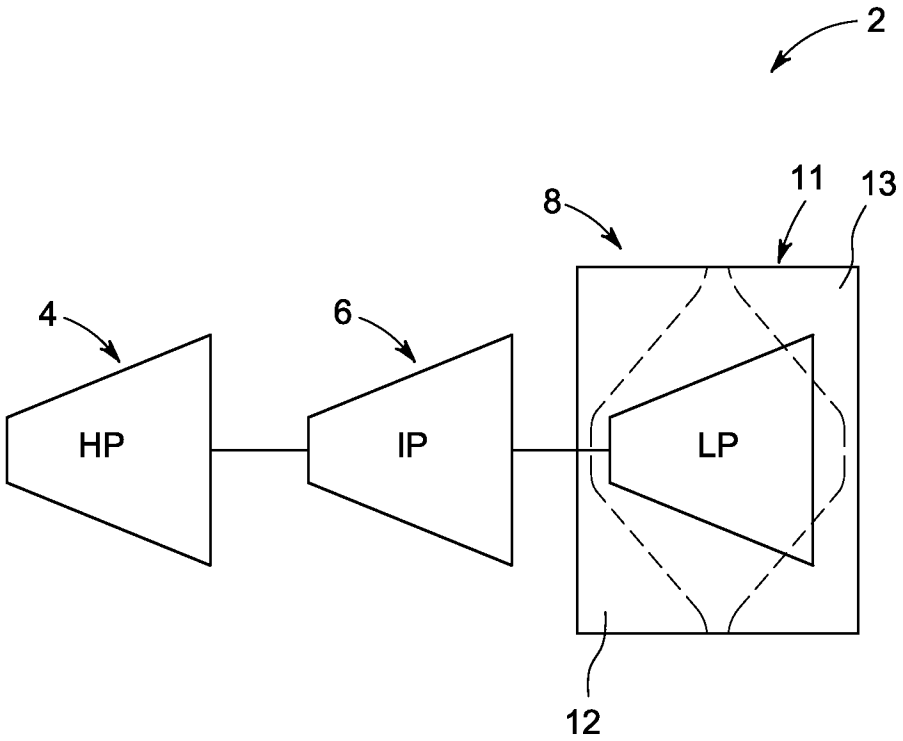
FIG. 1 is a schematic representation of a steam turbomachine system including a low pressure (LP) steam turbine portion having an exhaust hood provided with a butterfly plate formed in accordance with an exemplary embodiment.

Referencing FIG. 1, a steam turbomachine system in accordance with an exemplary embodiment is indicated generally at 2. Steam turbomachine system 2 includes a high pressure (HP) steam turbine portion 4 operatively coupled to an intermediate pressure (IP) steam turbine portion 6 which, in turn, is operatively coupled to a low pressure (LP) steam turbine portion 8. In the exemplary embodiment shown, LP steam turbine portion 8 includes an exhaust hood 11. Exhaust hood 11 includes a first exhaust hood section 12 joined to a second exhaust hood section 13 about LP steam turbine portion 8. As each exhaust hood section 12, 13 is substantially similar, a detailed description will follow with reference to first exhaust hood section 12 with an understanding that second exhaust hood section 13 includes corresponding structure.

Figure 2:
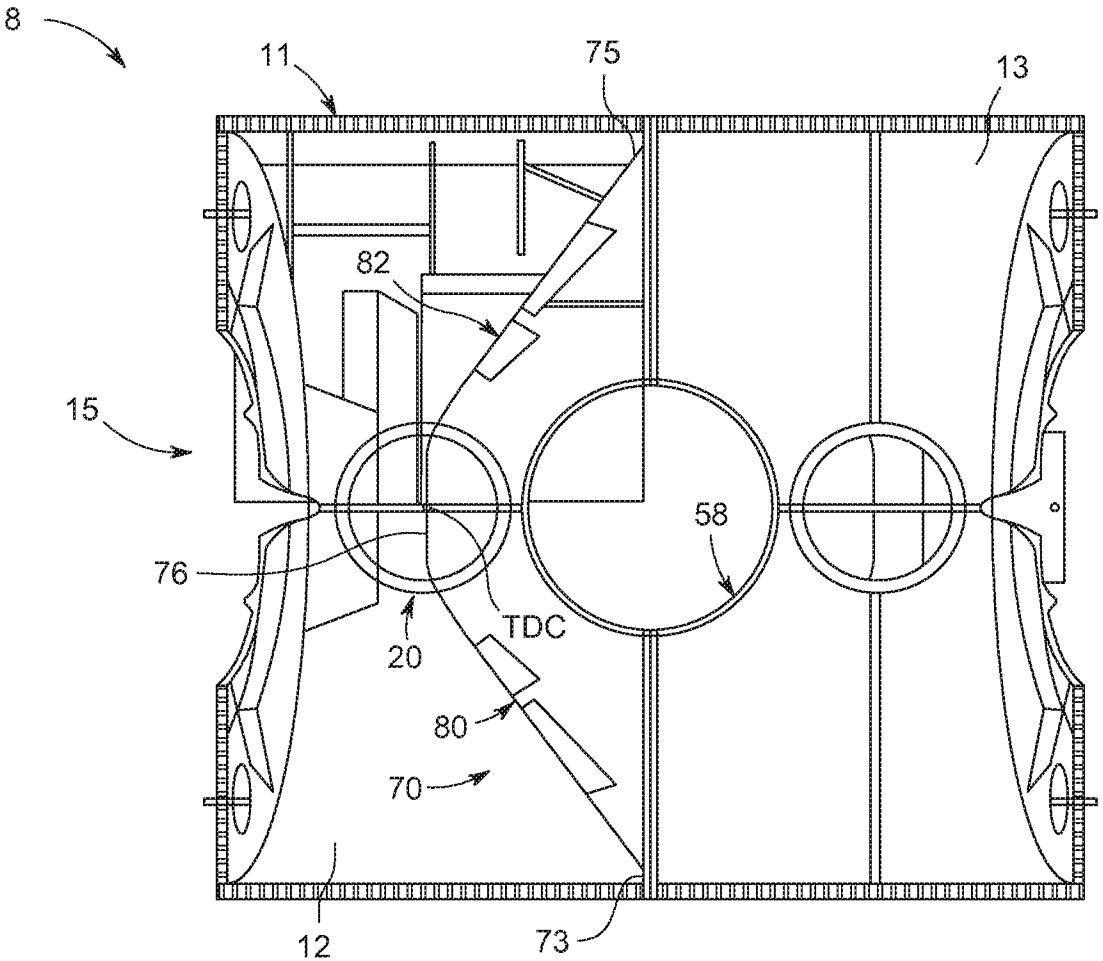
FIG. 2 is an upper plan view of the LP steam turbine portion and exhaust hood in accordance with an exemplary embodiment.
Figure 3:
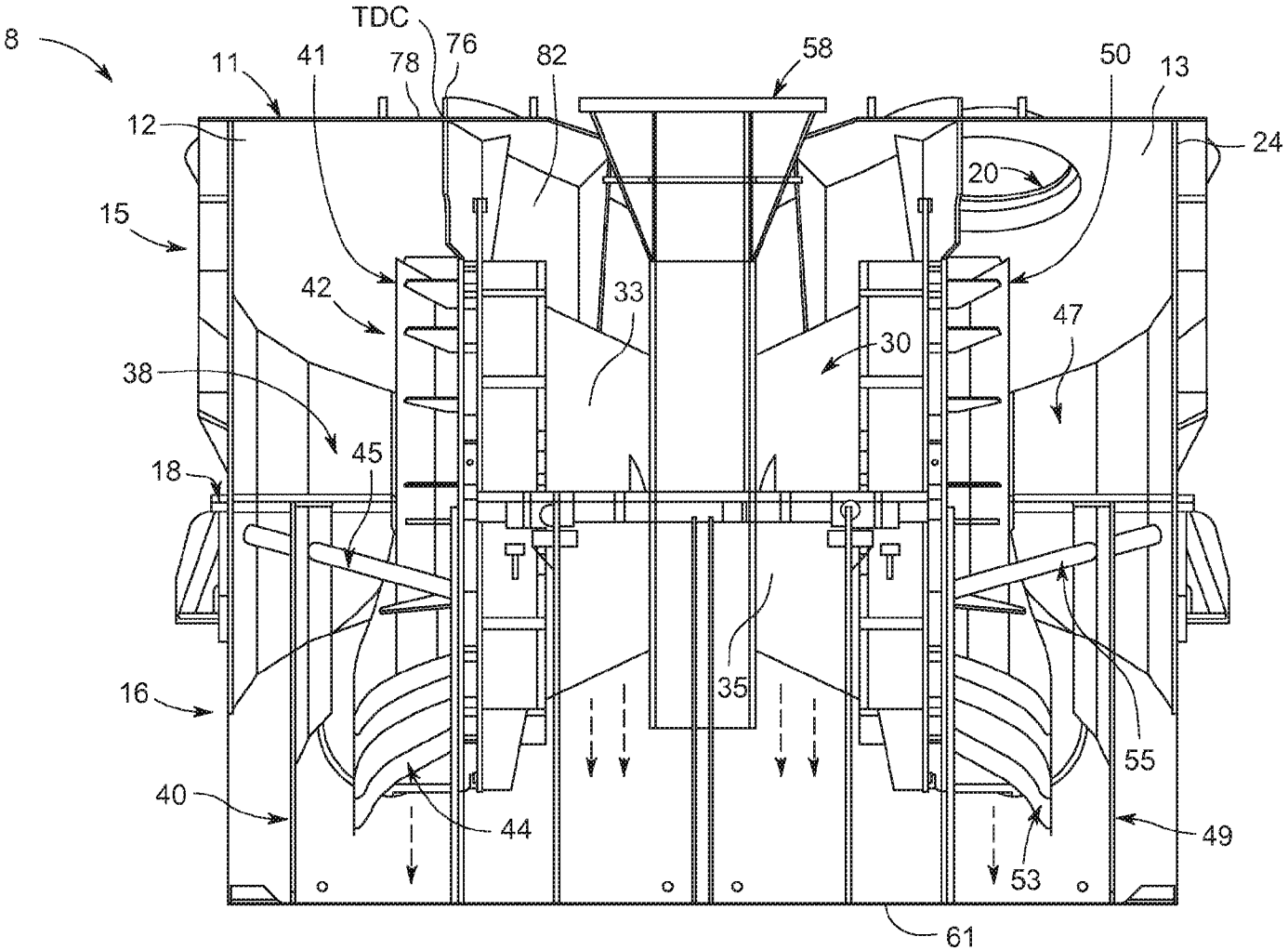
FIG. 3 is an elevational cross-sectional view of the LP steam turbine portion and exhaust hood of FIG. 2.

As best shown in FIGS. 2-3, first exhaust hood section 12 includes a main body 14 defined by an upper shell portion 15 and a lower shell portion 16 that are coupled along a horizontal joint 18. As shown, upper shell portion 15 includes a pressure relief opening 20 (shown in an open configuration) that leads to an interior housing 24 which encloses LP steam turbine portion 8. Pressure relief opening 20 is generally in a normally closed configuration that opens to alleviate a pressure that may build up within interior housing 24. LP steam turbine portion 8 is positioned within interior housing 24.

In the exemplary embodiment shown, LP steam turbine portion 8 includes an inner casing 30 that houses a first steam turbine section 33 and a second steam turbine section 35. First steam turbine section 33 includes a first bearing cone 38 that is supported within interior housing 24 by a first Herzog plate 40. First bearing cone 38 defines a first steam guide 41 having an outlet section 42 that allows steam to pass from first steam turbine section 33 into interior housing 24. First outlet section 42 includes a first guide member 44 that directs steam from first steam guide 41 into inner casing 30. Similarly, second steam turbine section 35 includes a second bearing cone 47 that is supported within interior housing 24 by a second Herzog plate 49. Second bearing cone 47 defines a second steam guide 50 having a second outlet section 51 that allows steam to pass from second steam turbine section 35 into interior housing 24. Second outlet section 51 includes a second guide member 53 that directs steam from second steam guide 50 into inner casing 30. As further shown, exhaust hood 11 includes an inlet 58 that guides steam from IP turbine portion 6 into first and second steam turbine sections 33 and 35 of LP steam turbine portion 8, and an outlet 61 that passes steam from interior housing 24 to a condenser (not shown).

In accordance with the exemplary embodiment, exhaust hood 11 includes a butterfly plate 70 that guides steam from upper shell portion 15 toward outlet 61. More specifically, steam exiting first and second outlet sections 42 and 51 above horizontal joint 18 must first flow upward within interior housing 24. The steam turns 90°, and flows toward butterfly plate 70. Butterfly plate 70 bends the steam another 90° toward outlet 61. In order to reduce pressure losses associated with vortices created by the multiple bends in the steam flow, butterfly plate 70 includes a particular cross-sectional profile.

Figure 4:
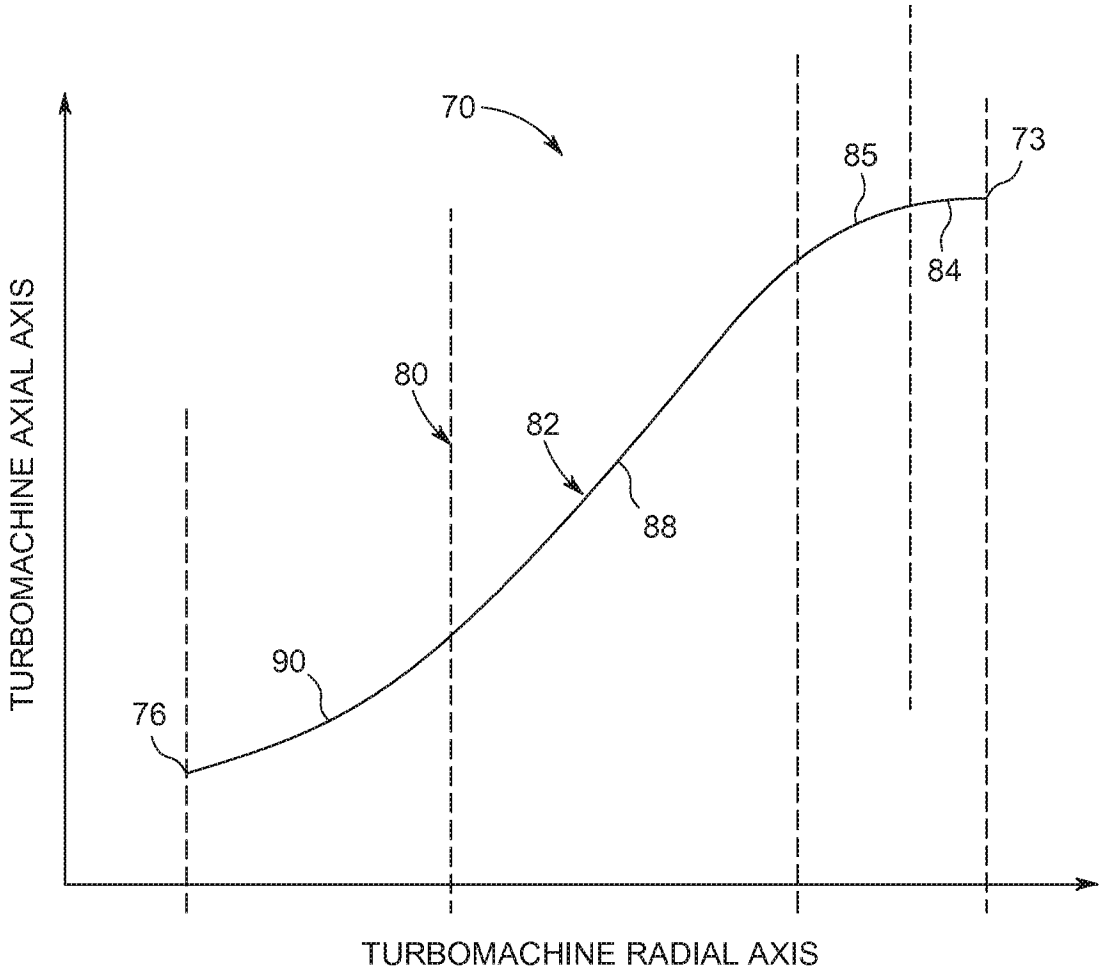
FIG. 4 is a graph illustrating a partial cross-sectional profile of the butterfly plate in accordance with an exemplary embodiment.

In accordance with an exemplary embodiment, butterfly plate 70 includes a first end portion 73 that extends to a second end portion 75 through a middle portion 76. A first section 80 is defined between first end portion 73 and middle portion 76, and a second section 82 extends between middle portion 76 and second end portion 75. As first and second sections 80 and 82 are substantially similar, reference will now be made to FIG. 4 in describing first section 80 with an understanding that second section 82 is a mirror image thereof.

First section 80 includes a complex curvilinear cross-sectional profile 82 having a first substantially linear segment 84 that leads to a first curvilinear segment 85 that in turn lead to a second substantially linear segment 88. Second substantially linear segment 88 leads to a second curvilinear segment 90 that extends through middle portion 76. First curvilinear segment 85 includes a negative curvature while second curvilinear segment 90 includes a positive curvature. The terms "negative" and "positive" are simply used to describe that first curvilinear segment 85 includes a curvature that is the opposite of the curvature of second curvilinear segment 90. The particular geometry of first section 80 can be described by the formula: $Y=0.94\ \Theta^6-1.86\ \Theta^5-0.86\ \Theta^4+2.9\ \Theta^3-0.75\ \Theta^2+0.5\ \Theta+0.6$ where $\Theta$ is the angle from top dead center (TDC) of exhaust hood 11 as shown in FIGS. 2 and 3, measured in radian and $0\leq\Theta\leq1.3$. Y is a non-dimensional distance from an outer end (not separately labeled) of first steam guide 41 with the constraint of $0<Y<0.15$ for middle portion 76. The formula defines the particular points that define the shape of butterfly plate 70. Actual non-dimensional distance of complex curvilinear cross-sectional profile 82 may lie within ±0.15 of Y.

Spacing between middle portion 76 and the outer end (not separately labeled) of first steam guide 41 as well as the overall shape of butterfly plate 70 contribute to reducing vortices in the steam flow exiting from LP steam turbine portion 8 above horizontal joint 18 towards outlet 61. Reducing vortices in the steam flow leads to fewer pressure losses and enhanced exhaust hood recovery. At this point it should be understood that the exemplary embodiments provide a mechanism for guiding steam flow from an upper portion in an exhaust hood toward a condenser. The butterfly plate is sized and shaped so as to reduce the creation of vortices in the steam flow to avoid efficiency loses in the turbomachine system.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A butterfly plate, the butterfly plate comprising:

a complex curvilinear cross-sectional profile having a first section that extends between a first end portion and a middle portion, and a second section that extends between the middle portion and a second end portion, one of the first and second sections being formed from at least two curvilinear segments including at least one curvilinear segment having a positive curvature and at least one curvilinear segment having a negative curvature.

2. The butterfly plate according to claim 1, wherein the butterfly plate is configured and disposed to be mounted in a steam turbine exhaust hood and wherein the one of the first and second sections includes at least one substantially linear segment.

3. The butterfly plate according to claim 2, wherein the at least one substantially linear segment extends between the at least one curvilinear segment having the positive curvature and the at least one curvilinear segment having the negative curvature.

4. The butterfly plate according to claim 2, wherein the one of the first and second sections includes two substantially linear segments.

5. The butterfly plate according to claim 2, wherein the one of the first and second sections follows a curvilinear path defined by the formula $Y=0.94\ \Theta^6-1.86\ \Theta^5-0.86\ \Theta^4+2.9\ \Theta^3-0.75\ \Theta^2+0.5\ \Theta+0.6$.

6. The butterfly plate according to claim 2, wherein the first section is a mirror image of the second section.

7. A steam turbine exhaust hood comprising:

an exhaust hood section; and a butterfly plate arranged in the exhaust hood section, the butterfly plate including a complex curvilinear cross-sectional profile having a first section that extends between a first end portion and a middle portion, and a second section that extends between the middle portion and a second end portion, one of the first and second sections being formed from at least two curvilinear segments including at least one curvilinear segment having a positive curvature and at least one curvilinear segment having a negative curvature.

8. The steam turbine exhaust hood according to claim 7, wherein the one of the first and second sections includes at least one substantially linear segment.

9. The steam turbine exhaust hood according to claim 8, wherein the at least one substantially linear segment extends between the at least one curvilinear segment having the positive curvature and the at least one curvilinear segment having the negative curvature.

10. The steam turbine exhaust hood according to claim 7, wherein the one of the first and second sections includes two substantially linear segments.

11. The steam turbine exhaust hood according to claim 7, wherein the one of the first and second sections follows a curvilinear path defined by the formula $Y=0.94\ \Theta^6-1.86\ \Theta^5-0.86\ \Theta^4+2.9\ \Theta^3-0.75\ \Theta^2+0.5\ \Theta+0.6$.

12. The steam turbine exhaust hood according to claim 7, wherein the first section is a mirror image of the second section.

13. The steam turbine exhaust hood according to claim 7, wherein the exhaust hood section includes an upper shell portion and a lower shell portion, the butterfly plate being arranged in the upper shell portion.

14. A steam turbomachine system comprising:

a turbine portion including an inlet section and an exhaust section; and an exhaust hood mounted about the exhaust section, the exhaust hood including:

an exhaust hood section; and a butterfly plate arranged in the exhaust hood section, the butterfly plate including a complex curvilinear cross-sectional profile having a first section that extends between a first end portion and a middle portion and a second section that extends between the middle portion, and a second end portion, one of the first and second sections being formed from at least two curvilinear segments including at least one curvilinear segment having a positive curvature and at least one curvilinear segment having a negative curvature.

15. The steam turbomachine system according to claim 14, wherein the one of the first and second sections includes at least one substantially linear segment.

16. The steam turbomachine system according to claim 15, wherein the at least one substantially linear segment extends between the at least one curvilinear segment having the positive curvature and the at least one curvilinear segment having the negative curvature.

17. The steam turbomachine system according to claim 14, wherein the one of the first and second sections includes two substantially linear segments.

18. The steam turbomachine system according to claim 14, wherein the turbine portion comprises a low pressure steam turbine.

19. The steam turbomachine system according to claim 14, wherein the first section is a mirror image of the second section.

20. The steam turbomachine system according to claim 14, wherein the exhaust hood section includes an upper shell portion and a lower shell portion, the butterfly plate being arranged in the upper shell portion.

* * * * *